US010520278B2

(12) United States Patent
Myers

(10) Patent No.: US 10,520,278 B2
(45) Date of Patent: Dec. 31, 2019

(54) AUTO-LOADING UNDERWATER FIREARM

(71) Applicant: Spike's Tactical, LLC, Apopka, FL (US)

(72) Inventor: James Randy Myers, Altamonte Springs, FL (US)

(73) Assignee: Spike's Tactical, LLC, Apopka, FL (US)

( * ) Notice: Subject to any disclaimer, the term of this patent is extended or adjusted under 35 U.S.C. 154(b) by 0 days.

(21) Appl. No.: 16/023,359

(22) Filed: Jun. 29, 2018

(65) Prior Publication Data

US 2019/0017773 A1 Jan. 17, 2019

Related U.S. Application Data

(60) Provisional application No. 62/526,607, filed on Jun. 29, 2017.

(51) Int. Cl.

| | |
|---|---|
| ***F41C 9/06*** | (2006.01) |
| ***F41A 21/28*** | (2006.01) |
| ***F41A 19/43*** | (2006.01) |
| ***F41A 3/66*** | (2006.01) |
| ***F41A 21/30*** | (2006.01) |
| ***F41A 19/14*** | (2006.01) |
| ***F41A 19/13*** | (2006.01) |
| ***F41A 3/54*** | (2006.01) |

(52) U.S. Cl.

CPC ..... *F41C 9/06* (2013.01); *F41A 3/54* (2013.01); *F41A 3/66* (2013.01); *F41A 19/13* (2013.01); *F41A 19/14* (2013.01); *F41A 19/43* (2013.01); *F41A 21/28* (2013.01); *F41A 21/30* (2013.01)

(58) Field of Classification Search

CPC ..... F41C 9/06; F41A 21/28
USPC ..... 42/1.14
See application file for complete search history.

(56) References Cited

U.S. PATENT DOCUMENTS

| | | | | |
|---|---|---|---|---|
| 2,503,491 A | | 4/1950 | Janz | |
| 2,916,970 A | * | 12/1959 | Mutter | F41A 21/00 89/14.3 |
| 3,300,888 A | | 1/1967 | Belcher et al. | |
| 3,417,719 A | * | 12/1968 | Nitenson | F41B 11/55 114/20.1 |

(Continued)

OTHER PUBLICATIONS

W.S.Brown M.A., "The Motion of an Underwater Projectile", Jan. 1946, 28pp, Glen Fruin Research Station Helenburgh, provided by Headquarters Air Material Command, Wright Field, Dayton, Ohio.

(Continued)

*Primary Examiner* — Joshua E Freeman
(74) *Attorney, Agent, or Firm* — Wood Herron & Evans LLP

(57) ABSTRACT

A shockwave impulse disruptor system for use in an underwater firearm. The system includes a barrel having a bore, a muzzle, and at least one barrel port. A housing is external to the bore and defines at least a first gas expansion chamber. The expansion chamber is in fluid communication with the barrel port and has at least one exhaust port. The barrel bore and expansion chamber are flooded when underwater. Propellant gases that push a projectile through the bore are vented through the barrel port to force water from the expansion chamber through the exhaust port and to vent propellant gases. This delays the release of gases to surrounding water and reduces the amount of gas expelled through the muzzle.

13 Claims, 12 Drawing Sheets

(56) References Cited

U.S. PATENT DOCUMENTS

| | | | | | |
|---|---|---|---|---|---|
| D214,496 | S | * | 6/1969 | Critcher | D22/104 |
| 2,453,763 | A | | 7/1969 | Barr et al. | |
| 3,453,763 | A | * | 7/1969 | Barr | F41C 9/06 42/59 |
| 3,494,060 | A | | 2/1970 | Hendricks | |
| 3,553,876 | A | | 1/1971 | Engler | |
| 3,585,934 | A | | 6/1971 | Mueller et al. | |
| 3,665,804 | A | * | 5/1972 | Rohr | F41A 21/28 89/14.3 |
| 3,677,132 | A | | 7/1972 | Plenge | |
| 3,721,031 | A | | 3/1973 | Falterman et al. | |
| 3,729,853 | A | | 5/1973 | Critcher | |
| 4,077,147 | A | | 3/1978 | Donnard et al. | |
| 4,357,888 | A | | 11/1982 | Phillips et al. | |
| 4,821,441 | A | | 4/1989 | Castro, Jr. et al. | |
| 5,355,765 | A | * | 10/1994 | Rogers | F41A 13/12 89/14.4 |
| 5,367,940 | A | | 11/1994 | Taylor | |
| 5,639,982 | A | | 6/1997 | Cipolla | |
| 5,753,846 | A | * | 5/1998 | Koon | F41A 21/28 42/75.02 |
| 5,798,473 | A | * | 8/1998 | Roblyer | F41A 21/28 42/75.01 |
| 5,844,162 | A | * | 12/1998 | Renner | F41A 21/18 89/14.3 |
| 5,911,568 | A | * | 6/1999 | Kirschner | F41C 9/06 42/1.14 |
| 5,966,858 | A | | 10/1999 | Curtis et al. | |
| 7,353,741 | B2 | * | 4/2008 | Brixius | F41A 13/06 42/90 |
| 8,074,556 | B2 | * | 12/2011 | Bantle | F41C 9/06 89/179 |
| 9,879,933 | B2 | * | 1/2018 | Myers | F41A 21/30 |
| 10,386,146 | B2 | * | 8/2019 | Spector | F41C 23/16 |
| 2010/0275493 | A1 | * | 11/2010 | Polovnev | F41A 21/34 42/90 |
| 2014/0013639 | A1 | * | 1/2014 | Polovnev | F41C 9/06 42/1.14 |
| 2016/0003570 | A1 | * | 1/2016 | Tonkin | F41A 21/02 89/14.4 |
| 2016/0187086 | A1 | * | 6/2016 | Eler | F41A 11/00 42/6 |
| 2016/0341509 | A1 | * | 11/2016 | Xu | F41A 21/28 |
| 2019/0101344 | A1 | * | 4/2019 | Polovnev | F41A 1/08 |

OTHER PUBLICATIONS

David Maccar, "How to Shoot a Glock Underwater", https://www.range365.com/how-to-shoot-glock-underwater, RANGE365, Sep. 28, 2016, printed on Jun. 26, 2018, 3pp.

* cited by examiner

AUTO-LOADING UNDERWATER FIREARM

RELATED APPLICATIONS

This application claims priority to U.S. Provisional Patent Application No. 62/526,607, filed Jun. 29, 2017, and incorporates the same herein by reference.

TECHNICAL FIELD

The present invention relates to a firearm for use underwater. More particularly, it relates to a firearm capable of semiautomatic or fully automatic fire without the need for creating or maintaining an evacuated (dry) barrel or other chambers.

BACKGROUND

When a firearm is discharged in the open atmosphere, the rapid release of pressurized propellant gasses through the muzzle creates a soundwave that travels through the air and to the ears of persons nearby. The sound travels by creating a compression wave through the air. This sound impulse can be reduced to a hearing-safe level by the use of a firearm noise suppressor, which typically includes a series of sealed chambers that temporality capture the high-pressure gas, allowing it to enter the atmosphere more slowly.

Because water is more dense than air, sound travels more than four times as fast through water than through air. Moreover, unlike air, water is nearly incompressible. When a firearm is discharged under water, the sound shockwave created is even more intense and travels even faster to the ears of people in the water. Discharging a firearm under water presents many challenges, including suppression of the sound shockwave to a level that is hearing safe and using the recoil energy to automatically extract a spent cartridge and load a new cartridge into the chamber without manually cycling the action or using a different, pre-loaded chamber.

Various underwater guns have been developed, many of which use a sealed barrel and/or flash and recoil suppressor, are capable of firing only a single shot without switching barrels/chambers, or that are effective only at contact range. One such device is shown in U.S. Pat. No. 3,300,888, which is a single shot device with a muzzle seal that is displaced or penetrated by the fired projectile. Another device "capable of being fired immediately after being subjected to moderate external water pressures" is described in U.S. Pat. No. 3,677,132, which shows a sound, flash, and recoil suppressor attachable to the threaded muzzle of a firearm barrel. This device uses a series of elastomeric wipes that are intended to reseal after penetration by a projectile.

U.S. Pat. No. 5,966,858 shows a muzzle brake and seal system that provides an evacuated chamber with internal baffles and a ball value at an exit port that is synchronized with the firing of a projectile. This system is intended to completely capture the propellant gases and any water that enters the capture chamber must be purged out between shots. U.S. Pat. No. 5,639,982 provides a method of firing a weapon underwater in which a blank cartridge is fired immediately before discharging a live round to purge water from the barrel and create a temporary bubble of gas at the muzzle. According to the method, once the repeated firing of live rounds has ended, another blank cartridge is used to again purge the barrel and create a bubble at the muzzle before firing another live round. Other devices use a series of pre-loaded chambers/barrels, like a revolver, that are selectively fired. In addition to other limitations, these devices would not be hearing-safe.

More recently, a water-filled sound and flash suppressor attached to the muzzle of a pistol has been used. This system temporarily captures and slows the propellant gases leaving the muzzle, forcing water inside the suppressor chambers to vent through radial ports. Although this device is effective at disrupting the sound shockwave produced by discharging the firearm, there may not be sufficient back pressure to cycle the slide or bolt, effectively making it a single shot system that must be manually cycled between rounds.

SUMMARY OF THE INVENTION

The present invention provides an auto-loading firearm capable of underwater semiautomatic or fully automatic fire at hearing-safe sound levels. The invention is capable of being implemented in an AR-platform firearm configured for pistol caliber ammunition using a blowback bolt. Various modifications and improvements are used in combination in a system that does not require any dry or purged chambers within the firearm, barrel, or brake system.

An impulse wave disruptor system may be integrated into a ported barrel assembly so that a muzzle-attached device is unnecessary. This can include a barrel having a bore, a muzzle at a forward end, and at least one barrel port. A housing external to the bore defines at least a first gas expansion chamber in fluid communication with the barrel port and having at least one exhaust port. The barrel bore and expansion chamber are flooded when underwater and propellant gases that push a projectile through the bore are vented through the barrel port to forcefully expel water from the expansion chamber through the exhaust port and to vent propellant gases. This delays the release of gases released to surrounding water and reduces the amount of gas expelled through the muzzle. Other devices that separate and disrupt the bubble of propellant gases being released into the surrounding liquid medium may be used to further lessen the pressure shockwave.

Parts of the fire control system may include a streamlined or hydrodynamic profile to reduce drag as they move through a water-filled environment. Parts of the blowback bolt may be profiled to allow the passage, bypassing, or venting of fluid as the part is moved rapidly through a water-filled chamber. Likewise, the recoil buffer tube may be ported (or skeletonized) to allow controlled venting of water from and into the housing as the action cycles. Other challenges, including the reliable ejection of a spent casing from the upper receiver through the dense fluid medium of water.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawings, wherein.

DETAILED DESCRIPTION

Figure 1:
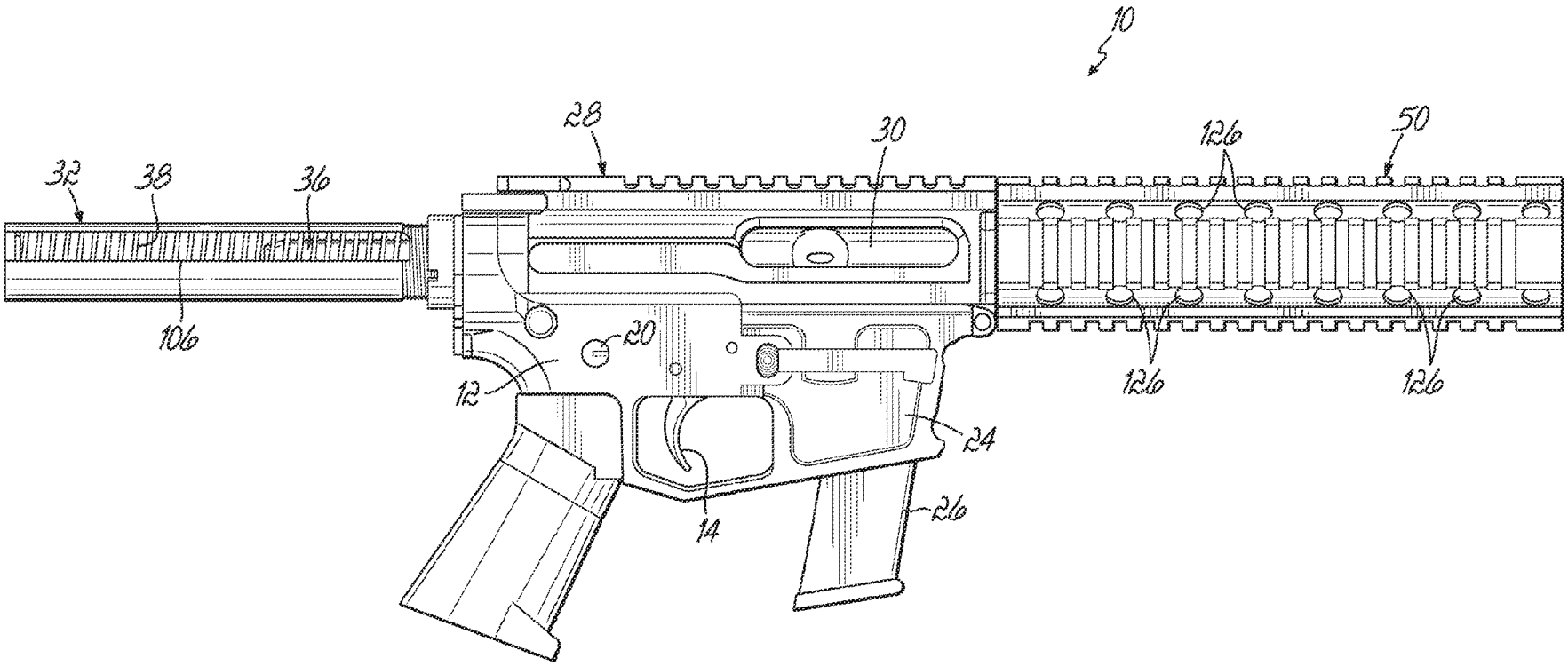
FIG. 1 is a side view of an auto-loading under water firearm according to one embodiment of present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" indicates the direction of the muzzle and the direction in which projectiles are fired, while "rearward" or "aft" indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
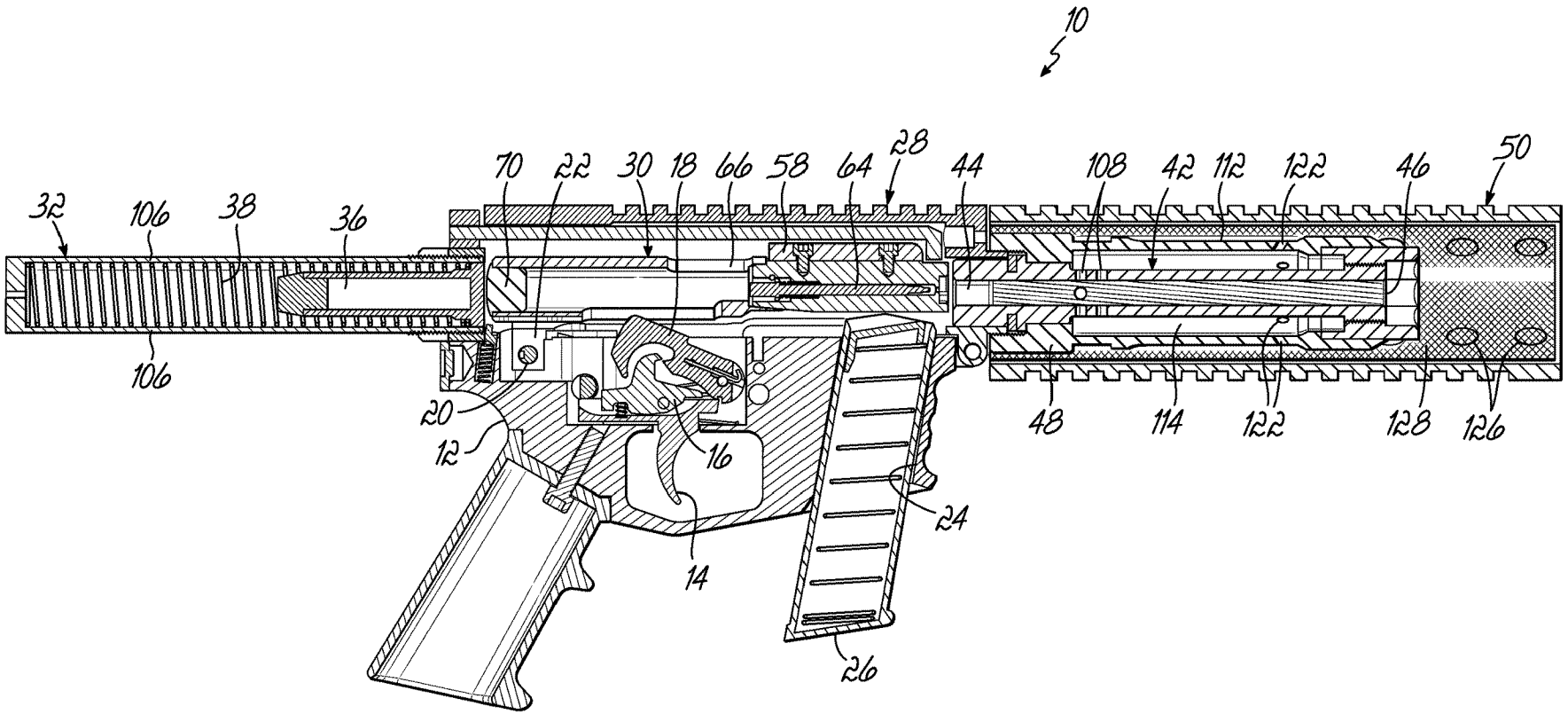
FIG. 2 is a side longitudinal sectional view thereof.

Referring to the various drawing figures, and first to FIGS. 1 and 2, therein is shown an auto-loading underwater firearm 10 according to an embodiment of the present invention. The invention may be implemented in a variety of handgun or rifle platforms. The illustrated embodiment is an AR-pattern receiver configured to fire pistol caliber ammunition. Pistol caliber handgun and carbine configurations of the AR-platform are well known. They typically include a lower receiver 12 that will accept standard parts of a fire control group, including a trigger 14, a disconnector 16, a hammer 18, and a rotatable safety selector switch 20, along with the various known springs and pins required for actuating and mounting the parts in the fire control group chamber 22 of the lower receiver 12. A forward portion of the lower receiver 12 includes a magazine well 24 that may be adapted or otherwise modified to accept a removeable magazine 26 for feeding ammunition cartridges (not shown) in the well-known manner. The illustrated embodiment is configured to use Glock™-pattern magazines, such as for 9 mm cartridges. Configurations for magazine patterns of other brands and/or other pistol or rifle caliber ammunition are also commonly known and could be used for the present invention. The distance a projectile will travel in water is determined most significantly by its shape, and less by its velocity as it leaves the muzzle.

An upper receiver 28 may be attached (in this case, removably) to the lower receiver 12. The upper receiver 28 houses a longitudinally reciprocating bolt carrier or bolt assembly 30, which will be described in more detail later. A buffer extension tube or housing 32 extends rearwardly from a rear portion of the lower receiver 12, substantially longitudinally and axially aligned with the bolt assembly 30 and interior chamber 34 of the upper receiver 28. The housing 32, which also will be described in more detail later, houses the recoil buffer 36 and recoil spring 38.

A barrel assembly 40 extends forward longitudinally from a forward portion of the upper receiver 28. The barrel assembly 40 may include a barrel 42, having a chamber 44 at its rearward end and a muzzle 46 at its forward end, a barrel attachment member 48, and a handguard 50. The barrel 42 may be rifled or smoothbore, and the type of projectiles to be fired depend on the user's purpose. As will be described in greater detail later, the barrel assembly 40 may include an integral impulse wave disruptor system.

In an underwater environment where all parts of the firearm are flooded with this liquid medium (except the interior of the ammunition cartridge), moving parts and the expelling of rapidly expanding propellant gases act and respond very differently than in a gaseous environment, like air. The liquid environment is essentially incompressible, which significantly changes how the fluid moves within enclosed spaces and passes through openings. The gas discharged into this liquid medium forms discrete bubbles and does not disperse the way discharged gas does in an air environment. The significant density differential exacerbates this effect.

Fire Control Group

Figure 3B:
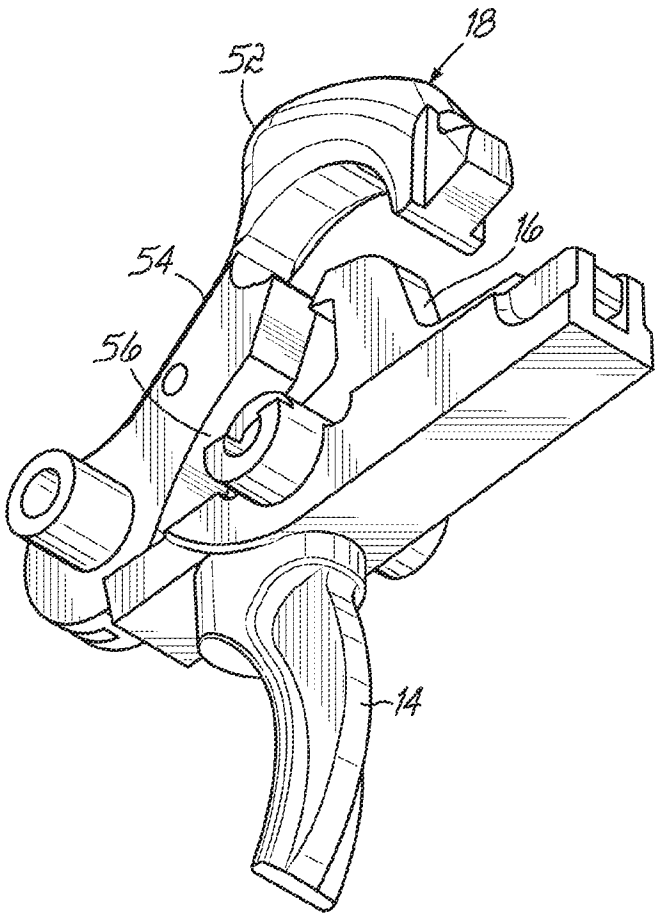
FIGS. 3A and 3B are isometric views of a fire control group according to an embodiment of the present invention.
Figure 3A:
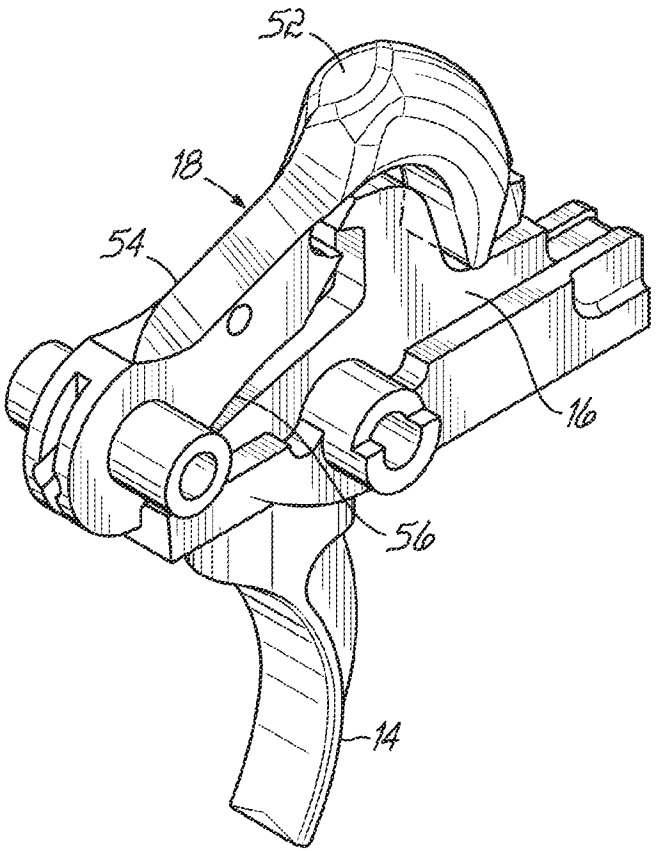
Figure 5:
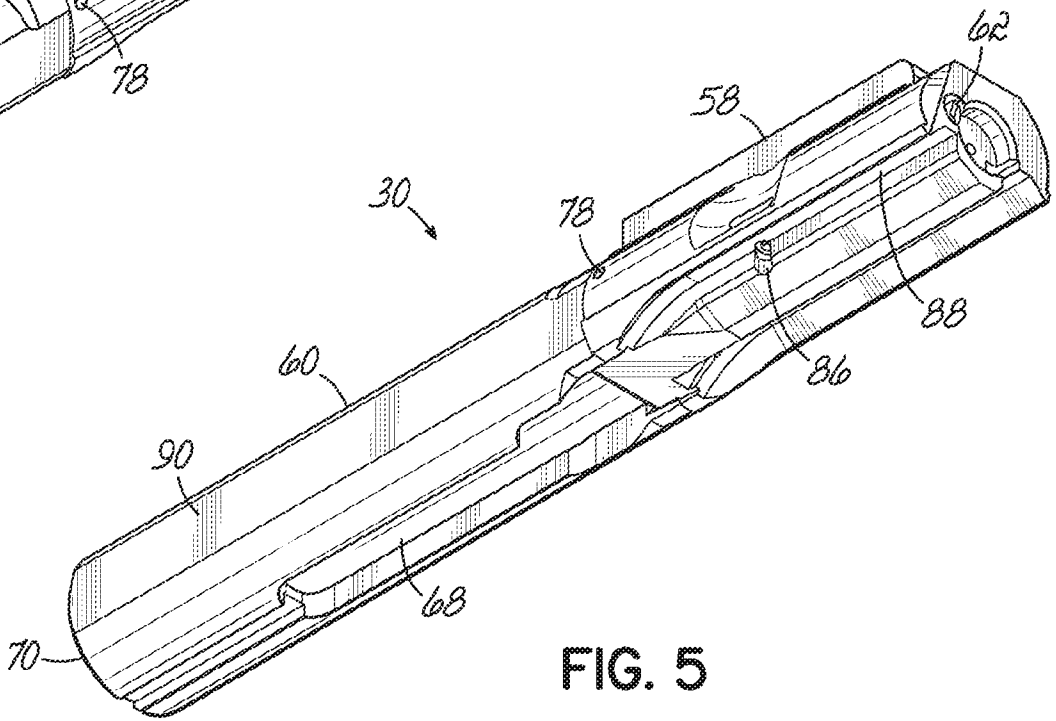
FIG. 5 is another isometric view thereof.
Figure 4:
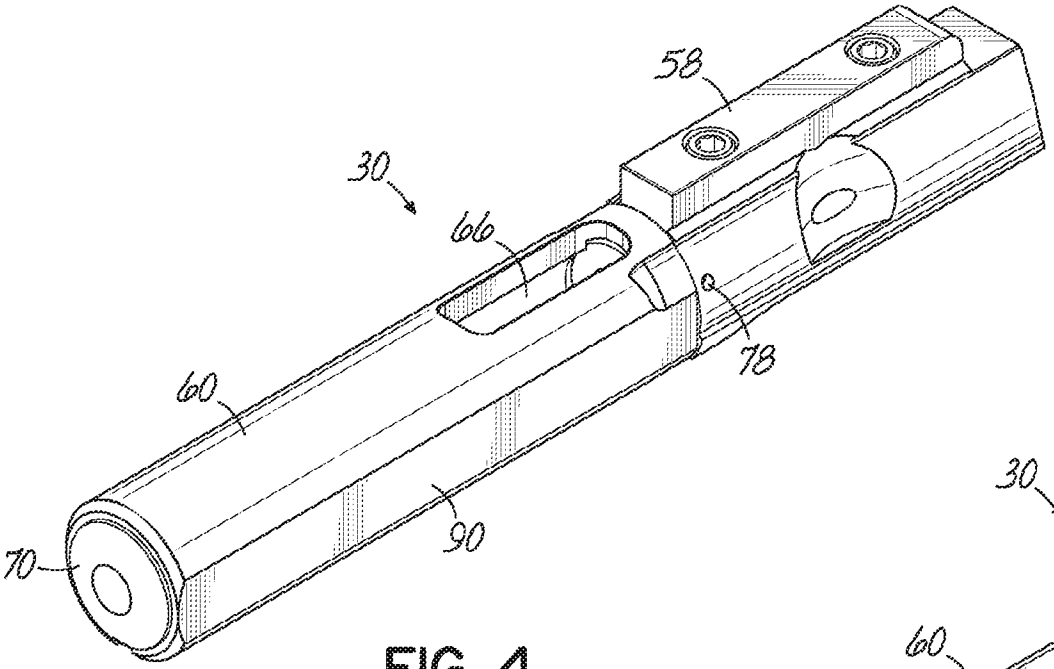
FIG. 4 is a first upper view of a blowback bolt according to one embodiment of the present invention.
Figure 6:
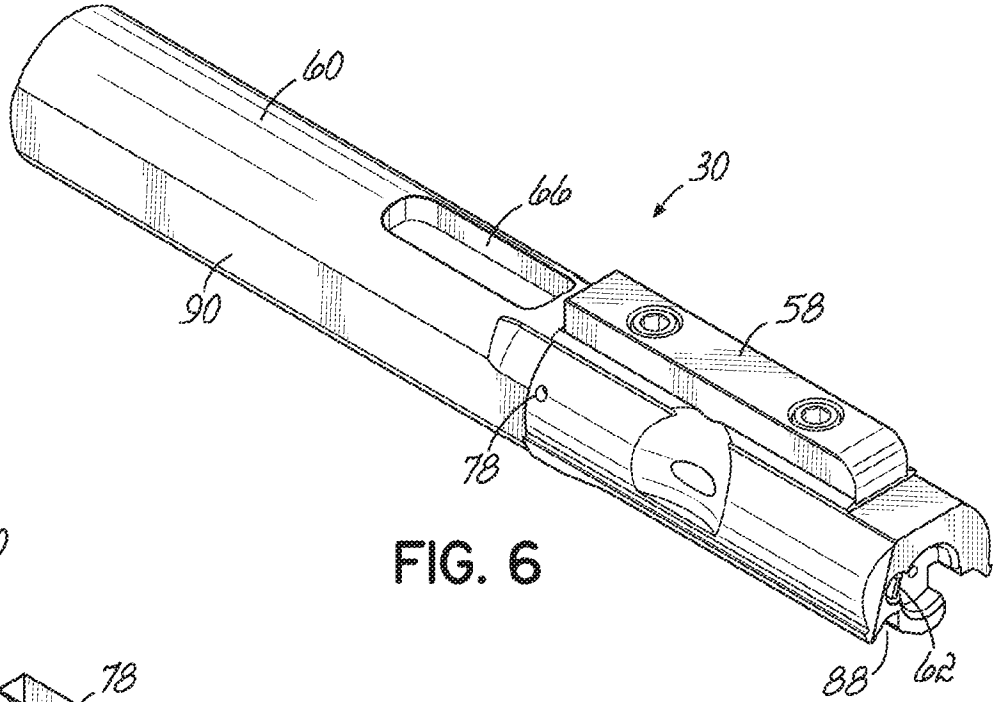
FIG. 6 is another isometric view thereof.
Figure 7:
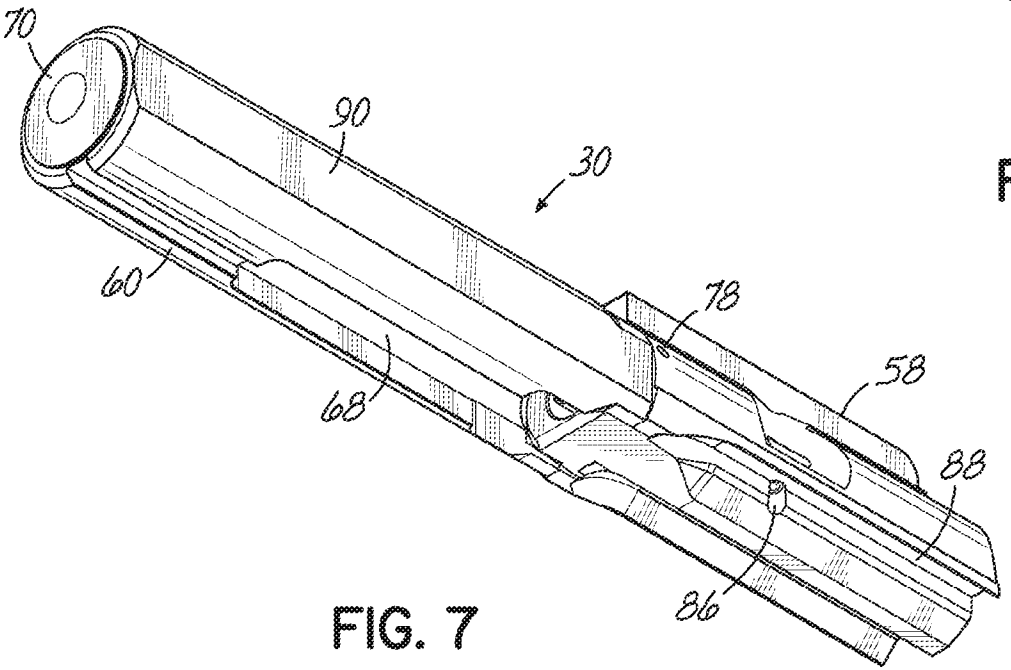
FIG. 7 is yet another isometric view thereof.
Figure 9:
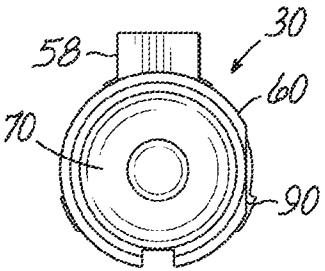
FIG. 9 is a view of the rear end of the bolt.
Figure 8:
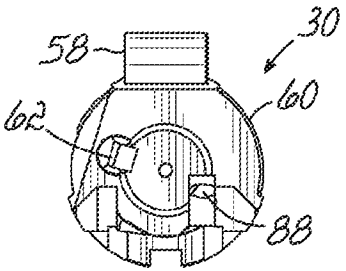
FIG. 8 is a view of the forward end of the bolt.
Figure 10:
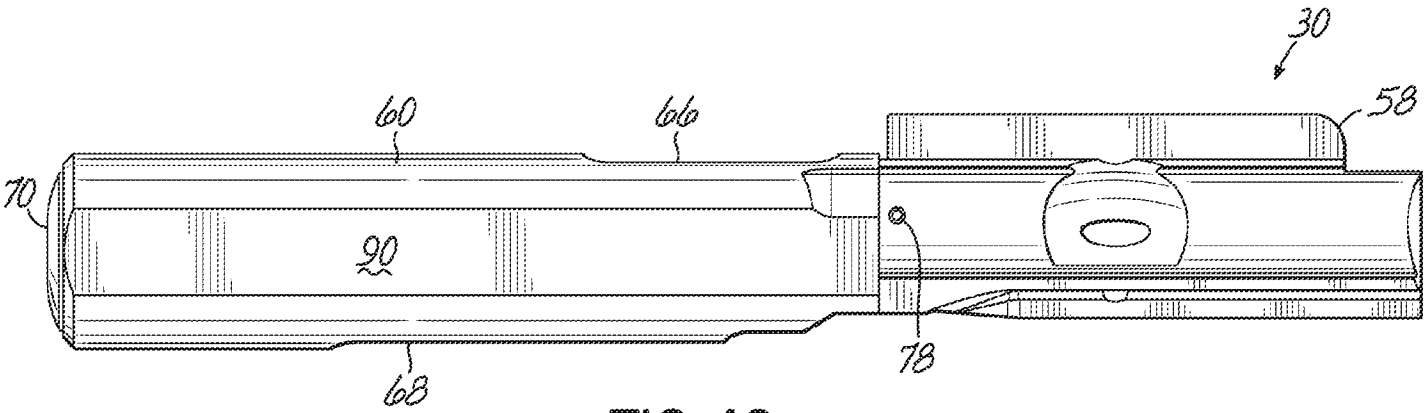
FIG. 10 is a side elevation view thereof.
Figure 11:
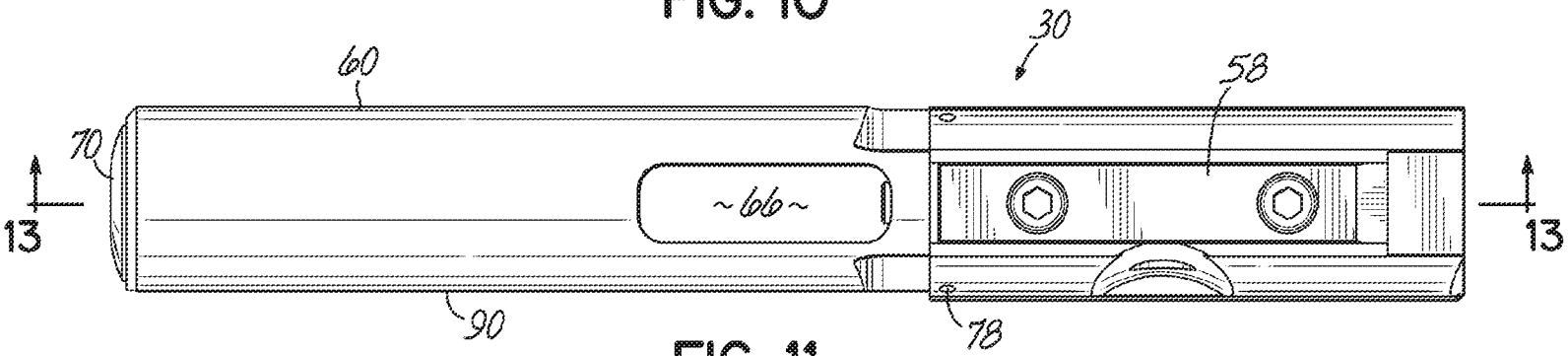
FIG. 11 is a top plan view thereof.
Figure 12:
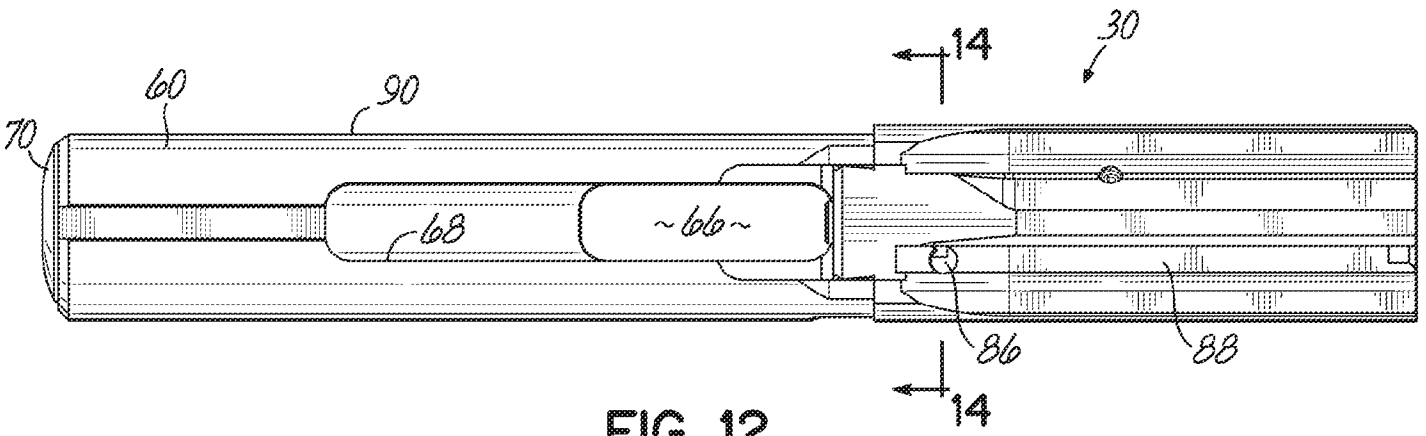
FIG. 12 is a bottom plan view thereof.

The hammer 18 is the largest and most rapidly moving part of the fire control group, which can present challenges when submerged in the denser liquid environment of water. Referring now to FIGS. 3A and 3B, according to one embodiment of the present invention, the profile of the hammer 18 may be streamlined to reduce drag when it moves rapidly through the water present in the fire control group chamber 22 when submerged. A substantially flat strike face 52 may be maintained where the hammer 18 will contact a firing pin 64 when released. Forward edge 54 may be feathered toward a ridge to create a streamlined shape, allowing water to flow around the hammer 18 with less resistance when it rapidly pivots under spring force. If desired the rearward edge 56 may also be streamlined in a similar manner (not shown). If necessary, a heavier hammer spring (not shown) may also be used. This can compensate for any loss of mass to the hammer 18 resulting from the streamlined/hydrodynamic profiling or any loss of velocity due to drag as it moves through the water.

The illustrated embodiment is a semiautomatic action. The present invention can easily be adapted for fully automatic fire by using a commonly known full auto fire control group and streamlining the full auto hammer 18 as shown and described.

Bolt and Firing Pin

As is commonly used in pistol caliber configurations of an AR-pattern firearm, a blowback bolt 30 may be employed in the present invention. Unlike the bolt carrier assembly in a typical gas-operated action of an AR-platform firearm, a blowback bolt 30 does not typically use a separate, rotating bolt member with locking lugs. Instead, the blowback blot 30 is maintained in battery by the recoil spring 38. Because the bolt 30 is not cycled, either directly or indirectly, by propellant gases ported from the barrel, a typical gas key is unnecessary. Instead, a guide key 58 that is either attached to or integral with the bolt body 60 may project upwardly from a top edge and received in a longitudinal keyway 59 inside the upper receiver 28 to guide the bolt 30 and prevent rotation as it reciprocates longitudinally when the action cycles. The bolt face may include an extractor 62 that engages the rim of an ammunition cartridge to remove it from the chamber 44 when the bolt 30 cycles rearwardly.

Axially aligned within the forward portion of the bolt body 60 is a firing pin 64, which will be described in further detail below. A rear portion of the bolt body 60 may have a substantially hollow interior with upper and lower cut-out openings 66, 68 to allow the hammer 18 to engage the firing pin 64. The rear end of the bolt body 60 may include a plug 70 that can be used to add mass to the bolt assembly 30 or to act as a bumper for the contact interface between the bolt assembly 30 and buffer 36.

Figure 13:
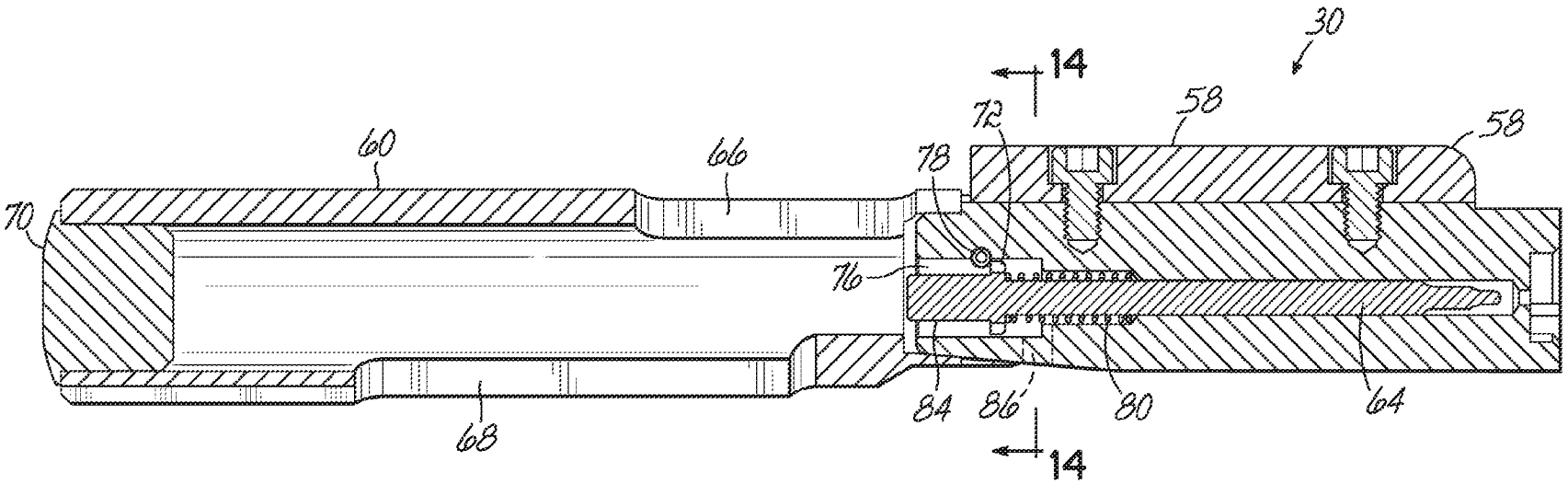
FIG. 13 is a side longitudinal sectional view thereof taken substantially along line 13-13 of FIG. 11.
Figure 14:
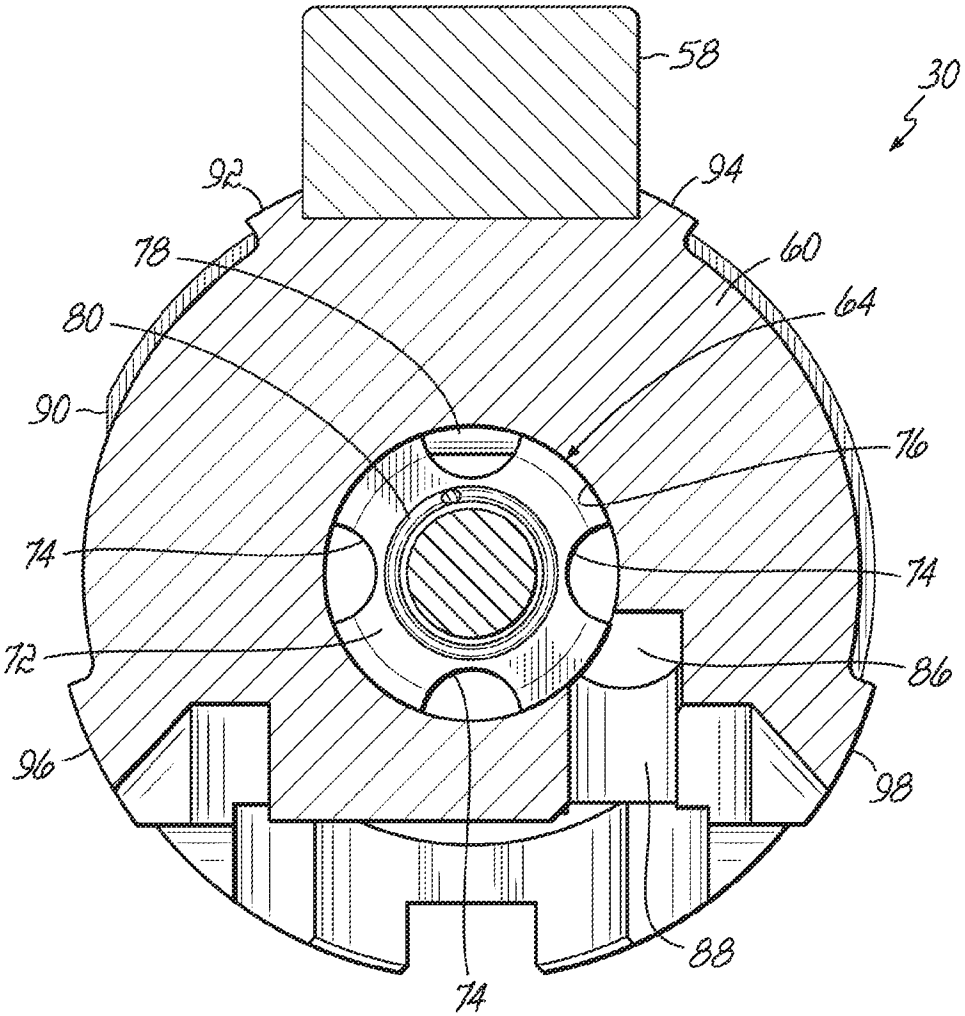
FIG. 14 is a cross sectional view thereof taken substantially along line 14-14 of FIGS. 12 and 13.
Figure 15:
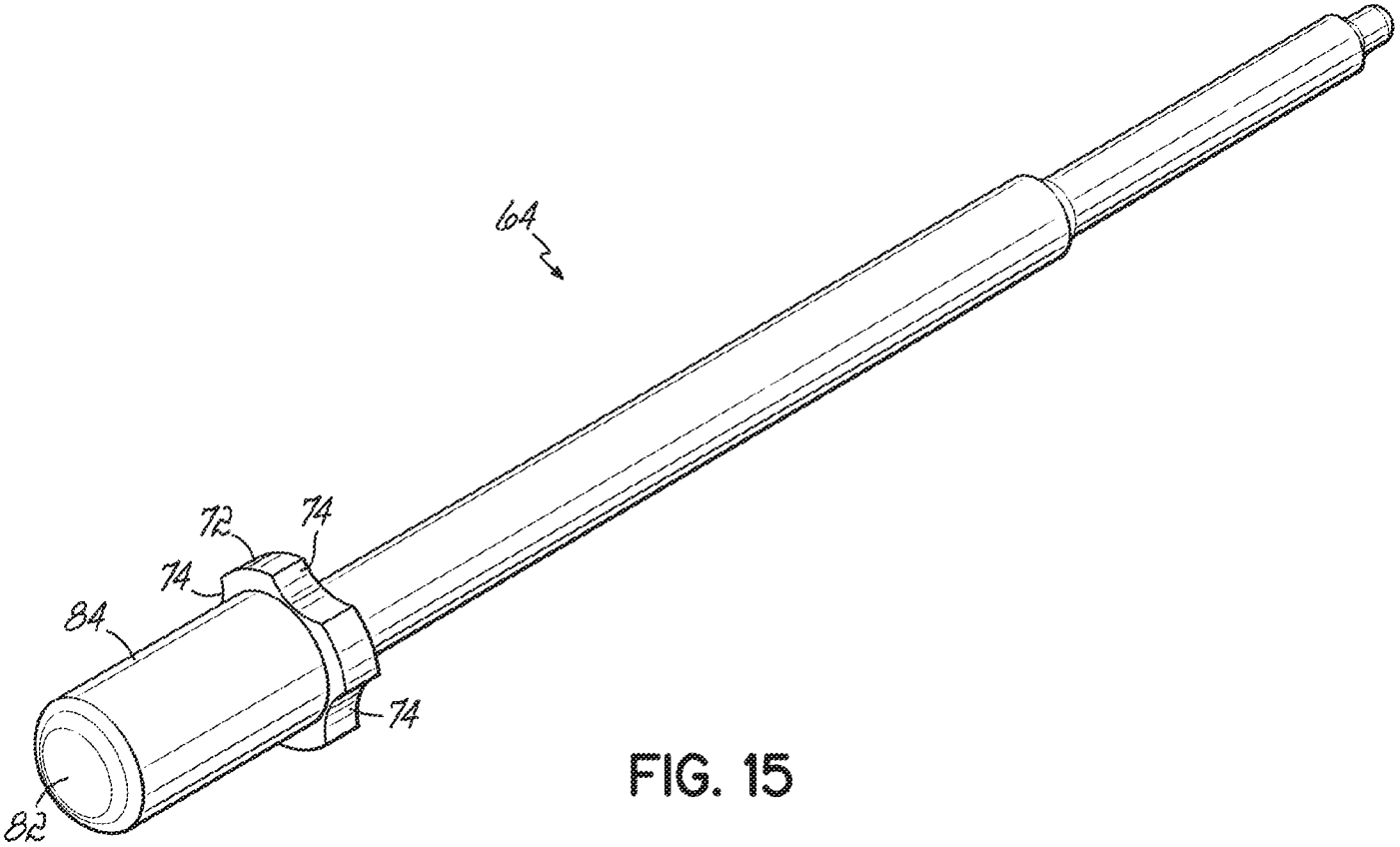
FIG. 15 is an isometric view of a firing pin according to one embodiment of the present invention.

One embodiment of the bolt assembly 30 may include other novel features making it particularly suitable and reliable in an underwater environment. Referring now also to FIGS. 14 and 15, the firing pin 64 may be modified in certain ways from that typically used in an AR-platform firearm. According to one aspect, the annular alignment shoulder 72 may be scalloped with a plurality of circumferentially spaced cut-outs 74. As seen in FIG. 13, the shoulder 72 guides and centers the firing pin 64 within an enlarged diameter chamber 76 axially centered within the bolt body 60. As in an ordinary AR-platform configuration, the shoulder 72 serves the additional purpose of allowing the firing pin 64 to be captured within the bolt body 60 by a retainer pin 78 situated in a transverse bore that partially intersects the chamber 76, blocking the shoulder 72. Additionally, the shoulder 72 can act as a bearing surface for a firing pin spring 80, if desired, that biases the firing pin 64 away from contact with a chambered cartridge (not shown) when the bolt assembly 30 is in battery until the rear end 82 is struck by the hammer 18, which overcomes the force of the spring 80 and propels the firing pin 64 forward. A complete shoulder would act as a piston within the chamber 76 which, when filled with incompressible water, would prevent or significantly inhibit rapid longitudinal movement of the firing pin 64. The cutouts 74 allow the shoulder 72 to pass through the water and for water to pass from one side of the shoulder 72 to the other with minimal, or at least significantly less, resistance. The portion of the firing pin 64 between the shoulder 72 and rear end 82 may also be configured to have a uniform diameter and substantially to match the diameter of the rear end 82. In an ordinary AR-pattern firing pin, this area would have a reduced diameter, proving an enlarged head portion at the rear to be struck by the hammer. Such an uneven profile could create turbulence and unnecessary resistance when such a firing pin is rapidly moved in the longitudinal direction through a dense fluid medium, like water. The uniform diameter of this rear portion 84 reduces such negative effects.

Referring now in particular to FIGS. 5, 7, 8, and 12-14, a relief vent 86 may be used to provide a fluid venting conduit between the chamber 76 and exterior of the bolt body 60. It is common for AR-pattern firearms configured for pistol caliber ammunition to use an ejector (not shown) that is fixed to the lower receiver to strike the head of the cartridge casing at a location substantially laterally opposite where the extractor engages the rim, rather than to use an ejector integrated into the bolt face. As illustrated, the relief vent 86 can be situated in a generally downward direction and can coincide with either of the longitudinal cuts 88 provided in the forward end of the bolt body 60. As shown in FIGS. 8 and 12-14, the relief vent may coincide with the longitudinal cut 88 that accommodates the ejector that extends upwardly from a location in the lower receiver 12. This relief vent 86, in combination with the cut-outs 74 on the alignment shoulder 72, allows substantially uninhibited and effective movement of the firing pin 64 when struck by the hammer 18.

Ejection Enhancement

In practice, there can be some difficulty with reliable automatic ejection of spent cartridge casings in an underwater environment. It was found that cartridge casings may too often "stovepipe" and be caught in the ejection port 100 of the upper receiver 28 as the bolt assembly 30 returned toward the in-battery position. To address this, another feature may be included on the bolt body 66 in the form of a longitudinal relief 90 provided by a flat surface cut on the otherwise substantially cylindrical outer surface of the rear portion of the bolt assembly 30.

Figure 17:
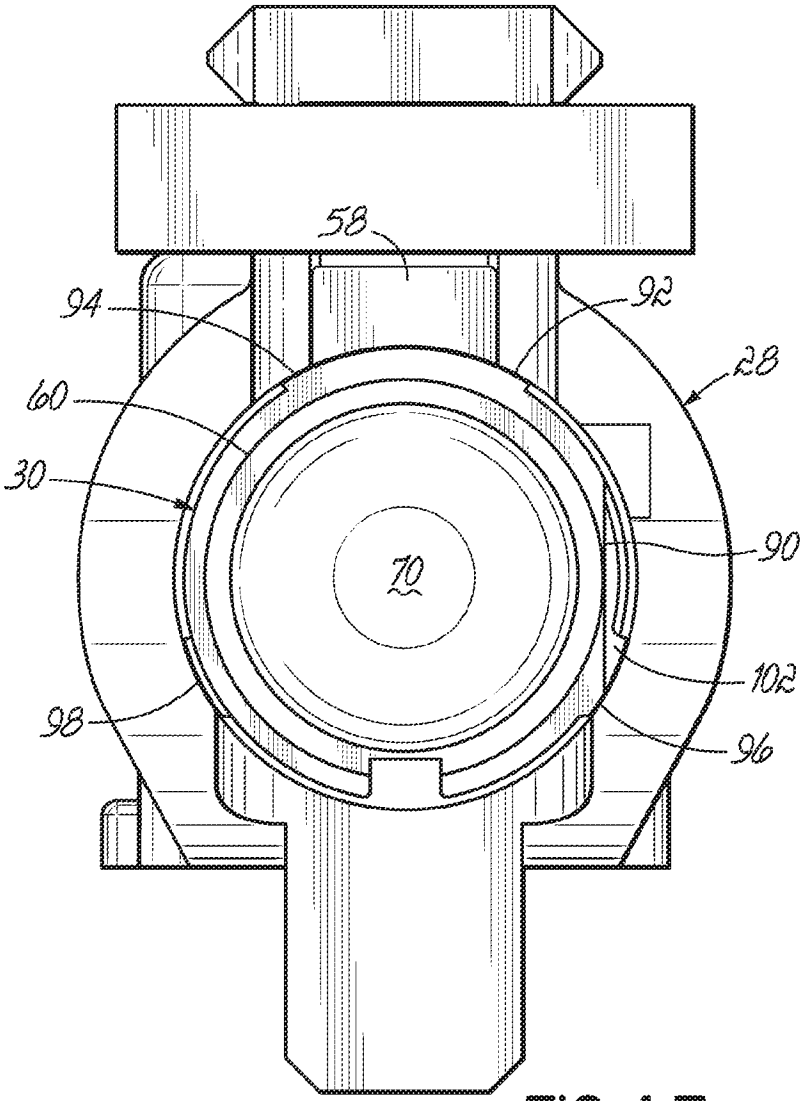
FIG. 17 is a rear view of an upper receiver with the bolt installed therein.
Figure 16:
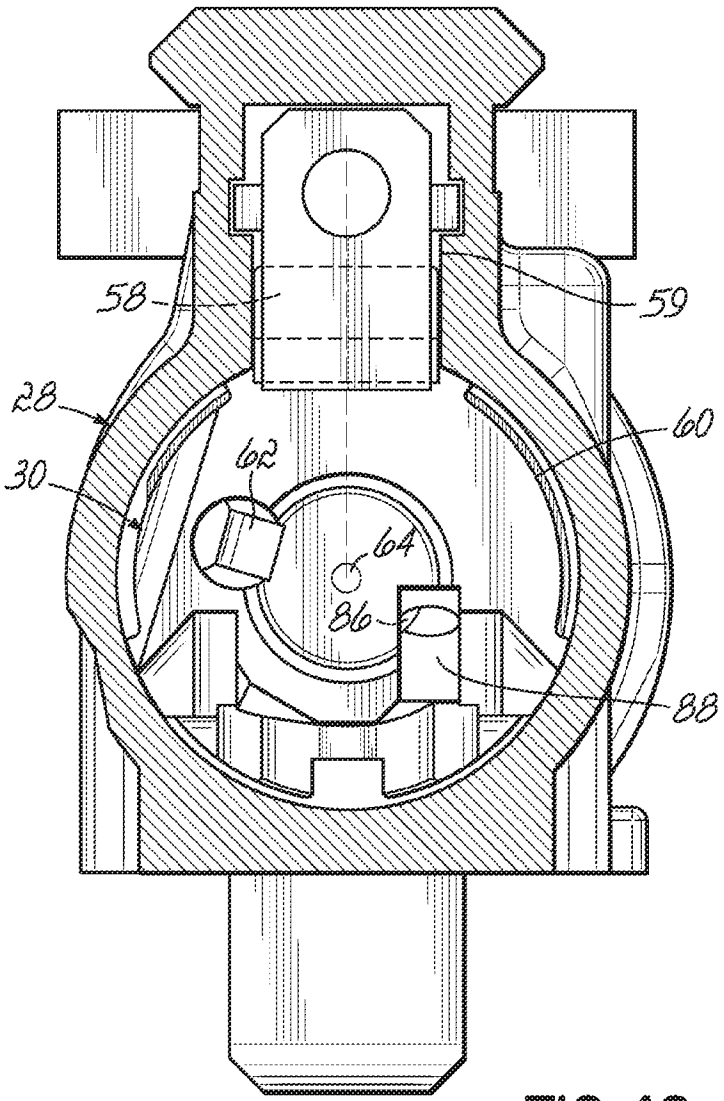
FIG. 16 is a cross sectional view of an upper receiver with the bolt partially retracted therein taken substantially along line 15-15 of FIG. 1.
Figure 18:
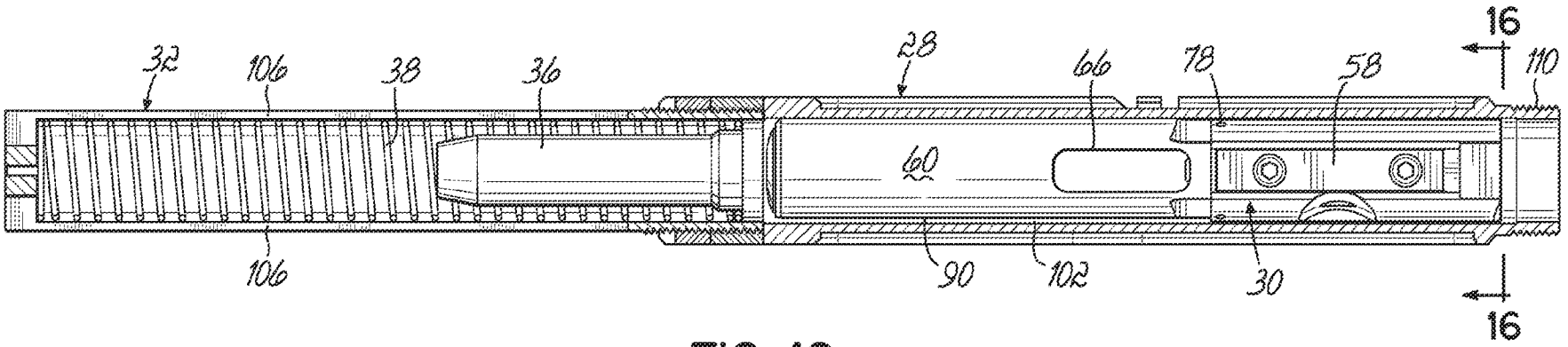
FIG. 18 is a top longitudinal sectional view of an upper receiver and buffer extension tube with a bolt, buffer, and buffer spring installed therein.

As shown in FIGS. 16 and 17, the otherwise substantially cylindrical rear portion nearly fills the substantially cylindrical interior chamber 34 of the upper receiver 28 with very limited clearance. The forward portion of the bolt body 60 makes contact with the substantially cylindrical surface of the upper receiver interior chamber 34 at four longitudinally extending bearing surfaces 92, 94, 96, 98, providing a somewhat greater space between the bolt body 60 and upper receiver 28 between the circumferentially spaced bearing surfaces 92, 94, 96, 98. It was found that the above-described relief 90 affected fluid flow of the liquid medium around the bolt body 60 as it longitudinally reciprocated, providing reliable ejection. As shown in FIGS. 17 and 18, the relief 90 creates a chamber 102 within the upper receiver that fills with water when submerged. Water may be drawn into this chamber 102 as the bolt assembly 30 and buffer 36 cycle to the rear and then pushed out again as they cycle forward. This change to the flow of water into and out of the interior chamber 34 of the upper receiver 28 through the ejection port 100 results in automatic ejection that is significantly more reliable than without the added chamber 102 formed by the relief 90 on this rear portion of the bolt body 60.

Recoil Buffer System

Referring now specifically to FIGS. 1, 2, and 18, certain modifications can be provided to the recoil buffer system. A standard buffer extension tube, whether used to support a rifle stock or in a pistol configuration, usually includes a small vent opening 104 in the rear end of the tubular housing. In an air environment, when the buffer 36 cycles to the rear, compressing the recoil spring 38, the compressible air inside the housing 32 can vent through the opening 104.

While such a vent is sufficient for an air environment, it is not sufficient to vent the more dense and incompressible liquid in an underwater environment. According to one embodiment, vent openings 106 of significant size may be formed along the length of the housing 32. For example, as shown, the vent openings 106 may be elongated slots cut substantially the full length of the housing 32 to open 20-30% of the surface area. Larger slots can be formed in the upper half of the housing 32, as shown, or a greater number of smaller slots may be circumferentially spaced around the housing. A series of separate openings (perforations) can be formed along the length and circumference of the housing 32. In practice, the housing 32 needs to retain only sufficient material and be configured to support the buffer and spring system 36, 38, but otherwise not trap water when the action is cycled.

A relatively heavy buffer 36, such as a T3, and a relatively heavy recoil spring 38, such as one intended for an AR10-platform (.308 caliber) firearm may be used. Optionally, an integrated spring/buffer system, such as the Silent Captured Spring system sold by JP Enterprises, Inc. of Hugo, Minn., for either the AR10, AR15, or 9 mm carbine, may be used. The Silent Captured Spring system (not shown) reduces sound-generating vibrations produced by an ordinary spring 38 rapidly rubbing the interior of the housing 32 as it compresses and extends. Likewise, an alternative type of spring recoil system housed entirely within the upper receiver can be adapted to the present invention with appropriate venting to assure water is not trapped in a chamber in a manner that could hinder or prevent normal cycling of the action in a liquid environment. Pneumatic buffer spring systems that are open to the atmosphere (i.e., not a closed system) may not be suitable for use in an underwater environment.

Impulse Disruptor Brake System

Unlike when a firearm is discharged in air, where high pressure propellant gases are released to the atmosphere, discharging a firearm under water rapidly creates a significant bubble of gas in a liquid environment. The rapid generation of this gas bubble creates an impulse in the form of a shockwave that radiates throughout the surrounding water. As previously described, it has been found that extending the release time of the propellant gas escaping the muzzle can greatly reduce this shockwave, to make underwater firing hearing safe. Additionally, dissipating this high-pressure gas into multiple streams creates many smaller bubbles, also greatly disrupting and reducing the shockwave effect. One prior solution used a muzzle-attached device with a central tube through which the projectile must pass without contacting the tube. This tube, of course, is filled with water as the projectile passes through it. That tube would be surrounded by an outer, water-filled chamber that would be temporarily evacuated by high pressure propellant gas ported from the central tube after leaving the muzzle of the firearm. One aspect of the present invention provides a propellant gas dissipater brake system, integral with the firearm barrel that disrupts the impulse of the shockwave to make underwater use of the firearm 10 hearing safe for those nearby.

Figure 19:
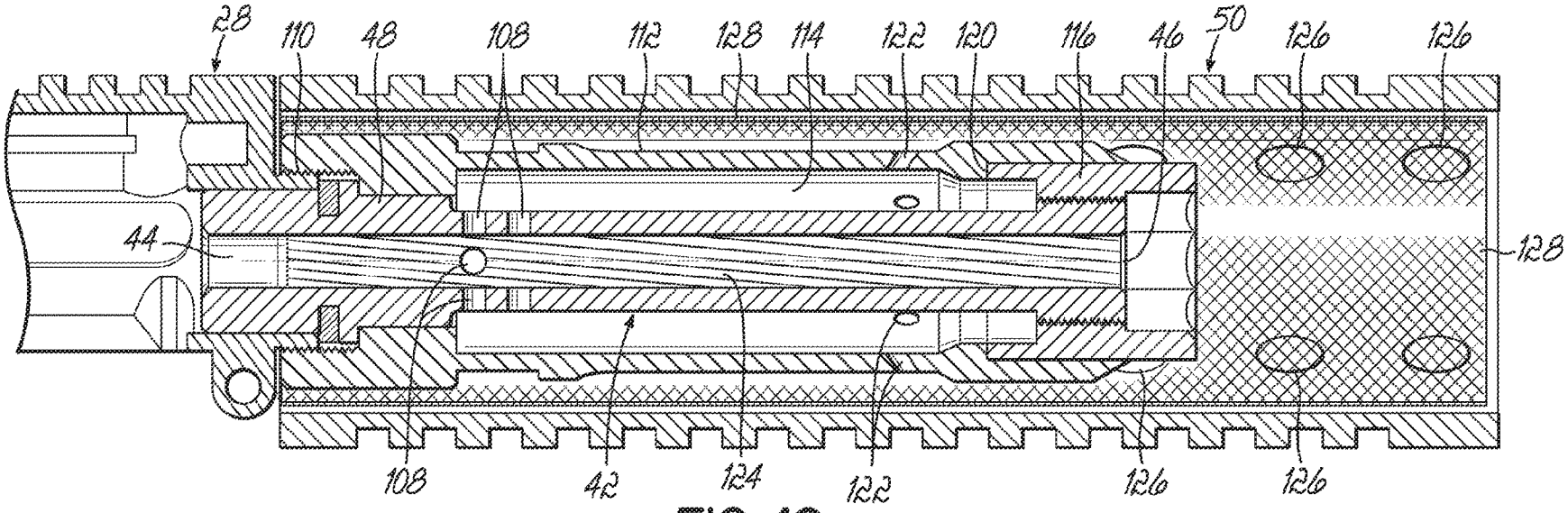
FIG. 19 is an enlarged longitudinal sectional view showing a portion of an upper receiver, barrel assembly, and barrel shroud according an embodiment of the invention.
Figure 20:
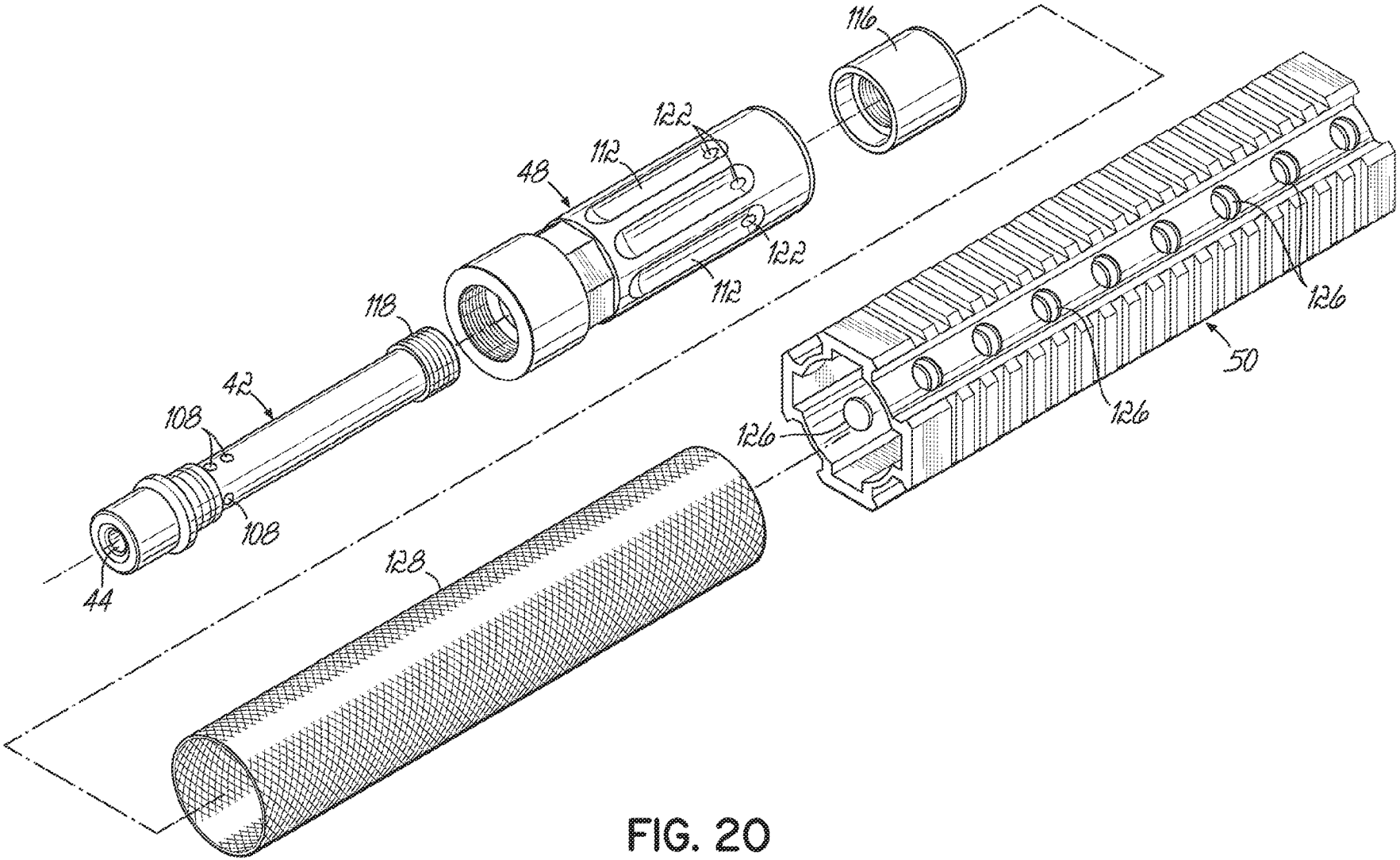
FIG. 20 is an exploded isometric view of a barrel an integral impulse disruptor system according to an embodiment of the invention.

Referring now in particular to FIGS. 19 and 20, the gas dissipater (shockwave disruptor) brake system according to one embodiment of the present invention combines a ported barrel 42 with one or more outer ported chambers that surround the barrel 42, aft of the muzzle 46. In the illustrated embodiment, the barrel 42 includes a plurality of ports 108 situated near the cartridge chamber 44. In this case, the radial ports 108 are within about the first one-fourth of the length of the rifled portion of the barrel 42, if the bore is rifled. The ports 108 are sized to vent a substantial portion of the propellant gas prior to a projectile leaving the muzzle 46 of the barrel 42. The illustrated embodiment includes six ports 108, four evenly circumferentially spaced nearest the breach or cartridge chamber 14 and two axially spaced slightly more distal therefrom. The number, size, and location of the ports 108 may be selected, depending on the specific caliber or load of ammunition to be used and/or the intended use of the firearm 10.

In the illustrated AR-pattern firearms 10, the barrel 42 may be attached to a forward threaded extension 110 of the upper receiver 28 using a threaded barrel attachment member 48 that functions as a traditional barrel nut. A tubular extension portion 110, which can be integral with the barrel attachment member 48, provides at least a first expansion chamber 114 radially exterior of and coaxial with the barrel 42. The forward end of the barrel 42 may be supported within the tubular extension portion 112 by a coupling nut 116 that engages a forward threaded portion 118 of the barrel and bears against an annular inner shoulder 120, placing the barrel 42 in axial tension, if desired. In this embodiment, the coupling nut 116 also acts to close the forward end of the annular first expansion chamber 110.

A plurality of exhaust ports 122 are provided through the tubular extension portion 112, which may be at or adjacent to the forward end of the expansion chamber 114. The exhaust ports 122 can be oriented to direct the fluid flow of water (and gas) radially, or may be oriented at a forward angle (shown) or rearward angle. Accordingly, expanding propellant gases flowing through the barrel ports 108 that enter the first expansion chamber 114 and force water out through the exhaust ports 122 and can create a recoil brake effect. The expansion in the first chamber 114 and work required to force water out through the exhaust ports 122 uses energy, delaying, reducing, and disrupting the pressure impulse that enters the surrounding water. The delay caused by evacuating water from the outer chamber 114 through the constricted exhaust ports 122 also helps maintain back pressure within the bore 124 to push the projectile being fired and to cycle the blowback bolt 30. In air, such early porting of the barrel might cause such an early and rapid drop in pressure within the bore 124 that projectile velocity would diminish and back pressure may not be sufficient to cycle the blowback bolt 30.

Once the water has been substantially or completely displaced from the expansion chamber 114, expansion gas may be further vented through the exhaust ports 118, as well. Once the propulsion gases have dissipated or their pressure falls below that of the surrounding water, water will refill the first expansion chamber 114 through the exhaust ports 122 and refill the bore 124 of the barrel 42 through the muzzle 46. Unlike prior devices that only dissipate propulsion gases after leaving the muzzle, the device of the present invention does so integral with the barrel, reducing the volume of blast exiting the muzzle 46. It also does not require the projectile to pass unguided through a liquid-filled tube forward of the muzzle, which may affect its velocity or accuracy.

The use of a barrel shroud or handguard 50 can further dissipate the gas flow exiting the exhaust ports 122, further disrupting the impulse and shockwave effect of the propellant blast. The handguard may be of any desired style (with or without accessory attachment rails) and may include a plurality of axially and circumferentially spaced openings 126 of any chosen shape or size. The volume of the radially spaced, water-filled cavities being evacuated by propellant gases is progressively larger as the radius increases. That is, the volume of the first expansion chamber 114 is greater than that of the barrel bore 124, and the volume within the handguard 50 is greater still. Each successive evacuation consumes energy that would otherwise be transferred to the surrounding water as a shockwave.

The handguard can be made of metal, such as stainless steel or anodized aluminum, or can be a fiber reinforced resin matrix composite, such as carbon fiber in epoxy. If desired, the handguard 50 can extend forward some distance (for example 1-4 inches) past the muzzle 46. Because a significant amount of propellant blast will still exit the muzzle 146 into the water environment, this rapidly expanding bubble can be inhibited and/or disrupted by this forward extension of the handguard 50.

Optionally, further disruption of the exhausted gas bubble can be achieved by use of a screen tube 128 situated in or on the handguard 50. The screen tube 128 may be made of any suitable material, such as stainless steel, aluminum, brass, carbon fiber, or fiberglass, that will withstand the pressurized gas flow and salt-water environment to which it may be subjected. The screen tube 128 can extend the full length of the handguard 50 (as shown), extend beyond the handguard, or may be less than the full length of the handguard, such as being positioned only adjacent the exhaust ports 122. If the handguard 50 and/or screen tube 128 extend forward beyond the muzzle 46, they can disrupt the impulse created by propellant gases exiting the muzzle 46. The screen material can be woven wires or fibers, or can be a series of perforations in a tube, either of which break apart bubbles of gas as it passes through. The screen tube may be spaced inward of the handguard 50 (as illustrated in FIG. 19), defining yet another radially spaced area between successive flow-limiting barriers through which the gas bubbles may be repeatedly divided/disrupted and recombined.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A shockwave impulse disruptor system for use in an underwater firearm, comprising:

a barrel having an axial length, a bore, a muzzle at a forward end, and at least one barrel port positioned aft of an axial length midpoint of the bore; and a housing external to the bore defining at least a first gas expansion chamber, the expansion chamber being in fluid communication with the barrel port and having at least one exhaust port positioned forward of the axial length midpoint of the bore, the barrel bore and expansion chamber being flooded when underwater, wherein, propellant gases that push a projectile through the bore are vented through the barrel port to force water from the expansion chamber through the exhaust port and to vent propellant gases, delaying the release of gases released to surrounding water and reducing the amount of gas expelled through the muzzle.

2. The system of claim 1, wherein the expansion chamber is coaxial with the barrel.

3. The system of claim 1, further comprising a barrel shroud extending around the barrel over at least a location of the exhaust port.

4. The system of claim 3, wherein the barrel shroud extends along substantially a full length of the barrel.

5. The system of claim 4, wherein the barrel shroud extends to a position forward of the muzzle.

6. The system of claim 3, wherein the barrel shroud includes a plurality of openings therethrough.

7. The system of claim 6, further comprising a screen member positioned radially between and spaced from both the exhaust port and the barrel shroud.

8. The system of claim 1, further comprising a tubular screen member positioned radially outward of and spaced from the exhaust port.

9. The system of claim 8, wherein the screen member extends to a position forward of the muzzle.

10. The system of claim 1, further comprising a fire control group including a hammer, the hammer configured to move in a pivotal direction and having feathered forward and rearward edges providing a profile streamlined in the direction of movement.

11. The system of claim 1, further comprising a bolt assembly that longitudinally cycles between in-battery and retracted positions within a receiver, the bolt including a firing pin configured to move axially within the bolt assembly, the firing pin including a perforate annular guide shoulder, and a chamber around a portion of the firing pin the chamber configured to guide the firing pin during axial movement and be divided into forward and rear compartments by the firing pin shoulder, and a fluid passageway connecting the forward compartment of the chamber to environment outside the bolt.

12. The system of claim 1, further comprising a bolt assembly that longitudinally cycles between in-battery and retracted positions within a receiver, the receiver including an ejection port, the bolt including an elongated body portion with an elongated relief portion that defines an elongated interior space between the body portion and the receiver through which, when submerged underwater, water can flow as the bolt assembly cycles.

13. The system of claim 1, further comprising a housing having a length extending aft from the receiver to house a recoil spring buffer system, the housing being vented along substantially its entire length to allow flow of fluid therethrough.

* * * * *